United States Patent [19]

Smith

[11] Patent Number: 4,736,677

[45] Date of Patent: Apr. 12, 1988

[54] VENTILATOR ASSEMBLIES

[75] Inventor: Nigel R. Smith, Colchester, England

[73] Assignee: Titon Hardware Limited, Colchester, England

[21] Appl. No.: 926,609

[22] Filed: Nov. 4, 1986

[51] Int. Cl.[4] ..... E06B 7/02

[52] U.S. Cl. ..... 98/98; 98/99.8

[58] Field of Search ..... 98/97, 98, 88.1, 99.6, 98/99.8

[56] References Cited

U.S. PATENT DOCUMENTS

| | | | |
|---|---|---|---|
| 1,958,342 | 5/1934 | Johnson | 98/99.8 |
| 2,221,497 | 11/1940 | Thomas | 98/98 |
| 3,343,475 | 9/1967 | Costley | 98/98.8 |
| 3,698,308 | 10/1972 | Navara | 98/98 |
| 4,280,647 | 7/1981 | Nilsson | 98/88.1 |

FOREIGN PATENT DOCUMENTS 2113825 8/1983 United Kingdom .

*Primary Examiner*—Larry I. Schwartz

[57] ABSTRACT

A sliding sash window ventilator assembly for insertion between the window sashes and the window frame comprises an elongate ventilator housing having an air passage through and between its inner and outer lateral faces and an elongate facing member mounted by a parallel motion linkage onto said ventilator housing, such that lengthwise movement of said facing member produces movement of said facing member towards or away from said housing between a fully closed position obstructing said air passage and a fully open position.

28 Claims, 4 Drawing Sheets

VENTILATOR ASSEMBLIES

This invention relates to ventilators for use in connection with openable windows and other glazing panels, the ventilators being of the type which can be used to provide a degree of ventilation when the openable window is in the closed position. This type of ventilation is usually now referred to as 'secondary ventilation'. It is particularly important in areas where external temperatures may be low or external weather inclement, for use to provide ventilation for dwellings and other accommodation where the high performance seal of modern windows might otherwise give rise to environmental problems such as condensation within the dwelling or accommodation.

The applicant's assignees have obtained a UK Pat. No. 2113825 which describes a ventilator intended to fit in the gap between a window sash and an undersized glazing panel. The ventilator has an upper tongue which fits into the sash in a manner equivalent to that by which the glass itself would be affixed to the sash, the ventilator having a lower channel into which the free edge of the glass locates. The ventilator in that patent is preferably of the type described in UK Pat. No. 1417751 of the present applicant's assignees having an elongate slotted backing member and an elongate facing strip mounted by spaced parallel motion links on the backing member, such that lengthwise movement of the facing strip also produces movement thereof towards or away from and parallel to the backing member between a fully closed position obstructing the slot or slots in the backing member and a fully opened position. The applicant's assignees also have a Norwegian Pat. No. 141351 which describes a similar type of ventilator but has a linkage arrangement differing slightly from that described in UK Pat. No. 1417751.

The present invention has as its object the provision of a secondary ventilator of the parallel motion linkage type for use in relation to sliding sash windows. One of the specific objects of the invention is to provide such an arrangement for post-fitting to existing sliding sash windows where it would be inappropriate or too economically burdensome to reduce the area of glass within a sash for fitment as described in UK Pat. No. 2113825. Any such ventilator must be constructed to allow the maximum degree of movement of one sash with respect to the other. The inner lower sash of the sash window will normally be provided on its upper edge with a catch arrangement for locking the two sashes together in the closed position. It is therefore an object of the present invention to provide for a ventilator assembly to allow a maximum degree of movement of the sashes with respect to one another in a manner not impeded by contact of said catch arrangement with the ventilator housing over a normal range of movement of the sashes with respect to one another. It is normal to provide a hood or cowl at the exterior of such a ventilator housing. Where a separate hood or cowl is provided means are required for a fixation of the hood or cowl to the ventilator housing. The present invention seeks to provide for particularly efficacious and cheap affixation of said hood to said housing by the point of fixing being displaced such that certain operations during manufacture of the housing can be conducted without hindrance. Finally, it is desired to provide an arrangement which gives satisfactory volume of air flow and an improved performance in the prevention of passage of particulates and/or moisture. The various aspects of the present invention seek to provide ways to avoid or reduce these and other problems.

According to one aspect of the present invention a sliding sash window comprises a window frame, inner lower and outer upper sashes mounted to slide respectively within inner and outer channels in said window frame, and a ventilator located between said sashes and said window frame, the said ventilator comprising an elongate ventilator housing having an air passage through and between its inner and outer lateral faces and an elongate facing member mounted by a parallel motion linkage onto said ventilator housing such that the length wise movement of said facing member produces movement of said facing member towards or away from said housing between a fully closed position obstructing said air passage and a fully open position, the housing further having substantially horizontal inner and outer sash facing surfaces, said inner and outer sash facing surfaces being substantially parallel to and spaced from one another.

According to a further aspect of the invention a sliding sash window comprises a window frame, inner lower and outer upper sashes mounted to slide respectively within inner and outer channels in said window frame, and a ventilator located between said sashes and said window frame, the said ventilator comprising an elongate ventilator housing having an air passage through and between its inner and outer lateral faces and an elongate facing member mounted by a parallel motion linkage onto said ventilator housing such that lengthwise movement of said facing member produces movement of said facing member towards or away from said housing between a fully closed position obstructing said air passage and a fully open position, the housing further being provided at its outer lateral face with an angular longitudinally extending channel for location of a member selected from the group consisting of an elongate exterior hood and a spacer for said elongate hood.

According to a still further aspect of the invention a sliding sash window comprises a window frame, inner lower and outer upper sashes mounted to slide respectively within inner and outer channels in said window frame, and a ventilator located between said sashes and said window frame, the said ventilator comprising an elongate ventilator housing having an air passage through and between its inner and outer lateral faces and an elongate facing member mounted by a parallel motion linkage onto said ventilator housing such that length wise movement of said facing member produces movement of said facing member towards or away from said housing between a fully closed position obstructing said air passage and a fully open position, said air passage comprising a first air flow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

In a particularly preferred form of the invention a sliding sash window comprises a window frame, inner lower and outer upper sashes mounted to slide respectively within inner and outer channels in said window frame, and a ventilator located between said sashes and said window frame, the said ventilator comprising an elongate ventilator housing having an air passage through and between its inner and outer lateral faces and an elongate facing member mounted by a parallel motion linkage onto said ventilator housing such that length wise movement of said facing member produces movement of said facing member towards or away from said housing between a fully closed position obstructing said air passage and a fully open position, the housing further having substantially horizontal inner and outer sash facing surfaces, said inner and outer sash facing surfaces being substantially parallel to and spaced from one another; the ventilator being further provided at its outer lateral face with an angular longitudinally extending channel for location of a member selected from the group consisting of an elongate exterior hood and a spacer for said elongate hood, and said air passage comprising a first air flow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

In a conventional twin sash sliding sash window the two sashes will of course be arranged to slide in channels in the window frame substantially parallel to one another, their adjacent surfaces being in substantially the same plane but of course spaced slightly to allow passage of one sash over another. With the two sashes in the normally closed position the outer sash, that is to say the one which will normally be closer to the exterior of the dwelling or accommodation, will normally have its top bar abutting the top of the window frame and its bottom bar substantially on a level with the top bar of the inner lower sash. The terms 'inner' and 'outer' are used in relation to that normal disposition of a twin sash sliding window. The terms 'upper' and 'lower' are used to describe the sashes in those closed positions although it is appreciate that in certain circumstances their positions can substantially be reversed without affecting their identity.

In any of these forms of the invention the ventilator may preferably be located between the outer upper sash and the said window frame, more preferably being affixed to the said window frame. The said outer sash facing surface preferably has substantially vertically depending flanges defining a channel to receive the said outer upper sash. Upper and lower channel means are preferably provided to locate a perforated screen over at least a portion of the outer face entry to the said air passage. Where a hood is provided the upper channel means for location of the said perforated screen is preferably defined in part by the said housing and in part by the said hood.

The ventilator arrangement of the present invention will usually be placed on the part of the window above the two sashes. A modification thereof may be constructed such that it may be located below said sashes, all features, aspects and integers described herein more particularly for use in the said upper location being applicable, mutatis mutandis, for use in said lower location.

The linkage in each case preferably comprises at least two parallel link members pivotally mounted on said facing member.

The invention also extends to a ventilator assembly per se. In one form of this aspect of the invention a ventilator assembly for a sliding sash window comprises an elongate ventilator housing with upper and/or lower surfaces, inner and outer lateral faces, an air passage through and between its inner and outer lateral faces and an elongate facing member mounted by a parallel motion linkage onto said ventilator housing such that lengthwise movement of said facing member produces movement of said facing member towards or away from said housing between a fully closed position obstructing said air passage and a fully open position; the sash facing surface having an inner section substantially parallel to and spaced from an outer section thereof. The said airflow passage preferably comprises a first airflow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections. In a further form of this aspect of the invention a ventilator assembly for a sliding sash window comprises an elongate ventilator housing with inner and outer lateral faces, an air passage through and between its inner and outer lateral faces and an elongate facing member mounted by a parallel motion linkage onto said ventilator housing such that lengthwise movement of said facing member produces movement of said facing member towards or away from said housing between a fully closed position obstructing said air passage and a fully open position, the assembly further being provided at its outer lateral face with an angular longitudinally extending channel for location of an elongate exterior hood. The said angular channel preferably comprises a first substantially horizontal section, the second substantially vertical section extending from the base of the first section.

In a further form of this aspect of the invention the ventilator assembly for a sliding sash window comprise an elongate ventilator housing with inner and outer lateral faces, an air passage through and between its inner and outer lateral faces and an elongate facing member mounted by a parallel motion linkage onto said ventilator housing such that lengthwise movement of said facing member produces movement of said facing member towards or away from said housing between a fully closed position obstructing said air passage and a fully open position, a first airflow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

The form of the various aspects of the invention in which the inner and outer sash facing surfaces of the housing are substantially parallel to and spaced from another provides several benefits. Firstly, it permits the inner sash to be raised in relation to the outer sash and in relation to the housing to the point where its upper edge is more or less parallel with the upper edge of the outer sash, any catch arrangement standing proud of the upper edge of the inner sash being in effect accommodated within a recess provided by the spacing of the inner and outer sash facing surfaces from one another. That moreover enables a cranked air passageway to be provided through and between the faces of the ventilator housing. In providing the cranked airflow in this way there is in effect an abutment surface to impede passage of particulates and moisture through the ventilator, the first outer section of the air passage being at a lower level than the third inner section of the air passage. The second connecting section of the air passage is substantially vertical and upwards (for inwardly flowing air) and in appropriate circumstances will permit deposition of particulates and moisture within the part of the ventilator facing the outer sash. Drain or other clearance means may be provided in the housing for removal of such particulates and moisture continuously or from time to time.

The forms of the various aspects of the invention which have the particular channel arrangement for receipt of the hood enables several benefits to be provided. Firstly affixation of the hood by providing the hood with an element complementary to the channel means that the hood may be fitted, located and retained by a single operation during manufacture. The use of the crank to channel having a first substantially horizontal section and a second substantially vertical section extending from the base of the first section provides a good longitudinal and torsional location of the hood and the displacement of the first section of the air passage enables that location and fixing of the hood to be made without deleterious impingement on the essential property of the ventilator, namely airflow. In a particularly preferred form of this arrangement a channel is defined at least in part by the hood and at least in part by the housing for locating a perforated screen. In an exemplary arrangement the perforated screen can simply be placed in position by an assembler, and placement of the hood with its extension within the channel will automatically lock the perforated screen in place.

Finally, the cranked airflow arrangement provides an additional manufacturing benefit in that the routing of the air passage entries at either lateral face of the extrusion of the housing can be effected from opposite sides of the housing thereby permitting simultaneous routing of the two sides, the displacement of the routing tools thereby ensuring that damage does not arise. Moreover approaching the routing from both sides enables shorter routing tools to be used as of course the longer the tool the greater the tendency of the distal end of the tool to displace itself from its rotational axis and thereby rout oversize passageways or cause distortion of the extrusion.

In another form of the invention a spacer may be provided between the ventilator housing and the hood. This is intended particularly for use with windows provided with a storm screen outside the normal window sashes. In that form of the invention the spacer is preferably provided at its inner end with means complementary to the said elongate channel and at its outer end with a spacer channel corresponding to the said elongate channel so that the hood may be affixed to the outer side of the spacer in just the same manner as the hood would be affixed to the housing in the absence of the spacer. The spacer will be provided with means to receive and locate a storm screen. The spacer/hood connection may also be provided with means for location of a perforated screen such that the screen is held in place between the spacer and the hood in the same manner as it would be held between the hood and the housing with the spacer not present.

The various aspects of the present invention may be put into practice in various ways. Some specific embodiments will now be described, by way of example, with reference to the accompanying drawings in which.

Figure 1:
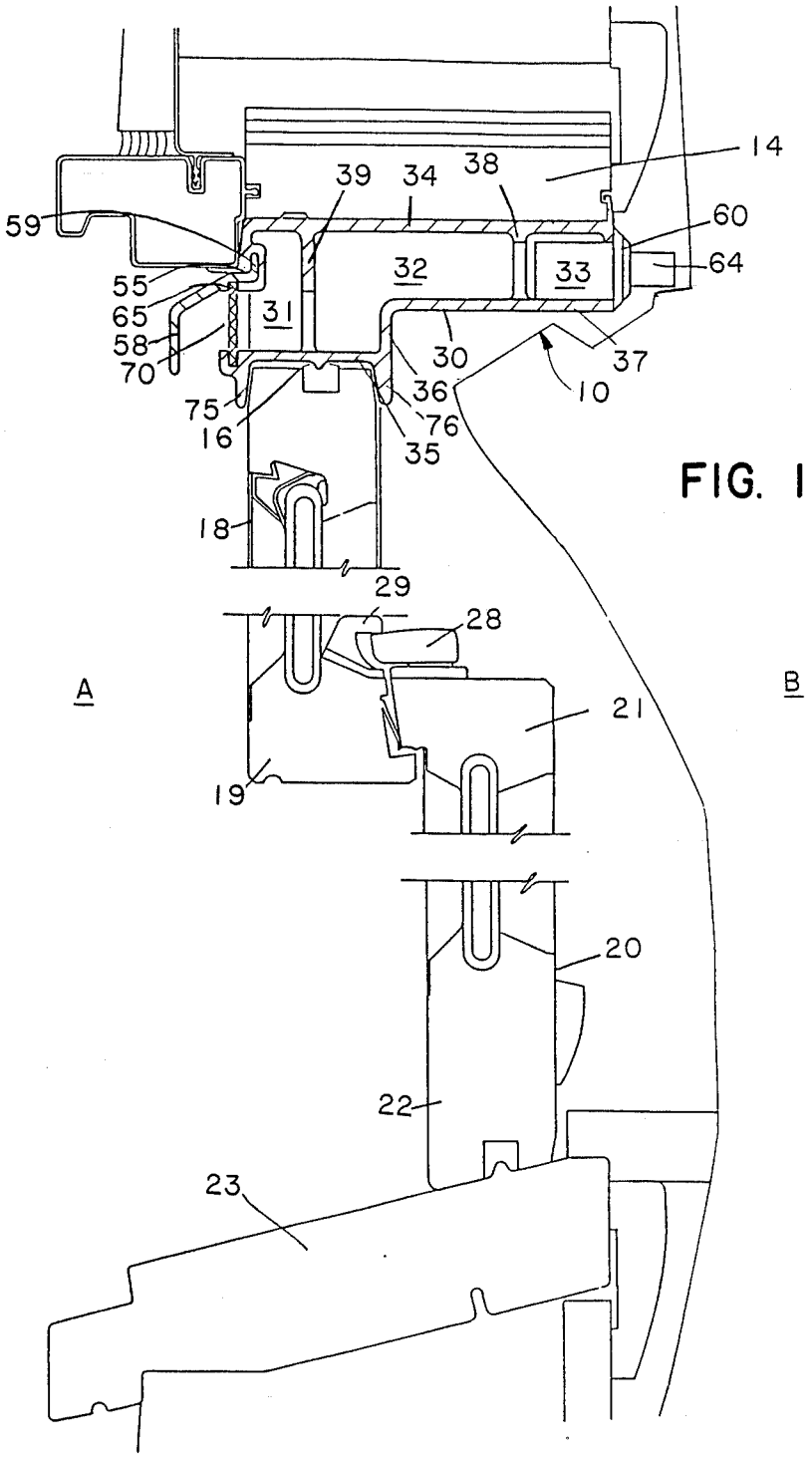
FIG. 1 is a cross-sectional view of a typical sliding sash window having a ventilator according to one aspect of the invention in position between the top bar of an upper outer sash and the horizontal bar or window frame.

Referring to the drawings, in FIG. 1 a ventilator 10 is located between the upper bar 14 of a window frame and the upper bar 16 of an upper outer sash 18. The lower inner sash 20 will be seen below. The lower bar of the sash 18 is designated 19, the upper bar of the sash 20 is designated 21 and the lower bar of the sash 20 designated 22. The plane of the lower surface of the lower bar of the window frame is designated 23.

The ventilator 10 comprises a housing 30. The housing 30 is an extrusion which extends horizontally between the top bar 16 of the sash 18 and the upper bar 14 of the frames. The shape of the extrusion will be better seen from FIG. 3. The section has an upper horizontal surface 34 and a lower horizontal surface made up of three sections 35 (facing the outer sash 18) 37 (facing the inner sash 20) and 36 linking sections 35 and 37. Between the upper and lower horizontal surfaces are three box sections 31 to 33 separated by partial walls 38 and 39. The housing 30 also has outer and inner lateral surfaces 40 and 42 respectively (see FIG. 3).

The housing 30 is extruded from a suitably rigid plastics material for example unplasticised polyvinyl chloride (UPVC) or some similar form-retaining plastics material, or may be made from a metal such as aluminium. It is extruded substantially as shown in FIG. 1 but of course with the inner and outer surfaces 40 and 42 and the walls 39 and 38 intact (this can be seen also in FIG. 3). In order to produce a ventilator to fit in the window an appropriate length of extrusion is selected and slot entries routed respectively through surface 40 and wall 38 on the one hand and surface 42 and wall 39 on the other to provide an air passageway through and between the surfaces 40 and 42. All of these routed surfaces and walls are left intact at the ends of the ventilator to provide structural integrity. It will be seen that the displacement tool which is required to cut from the inner face 40 may be displaced from that required to cut from the outer face 42 which means firstly that simultaneous routing can be undertaken from both sides and secondly that there need be no fear of impingement of one routing tool upon another.

Figure 5:
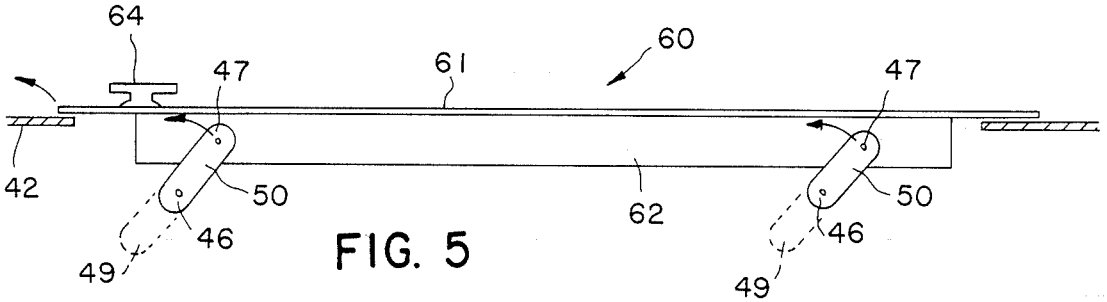
FIG. 5 shows the principal of operation of the parallel motion linkages of the ventilator which forms a part of the present invention.

There is affixed to the housing at its inner side adjacent the surface 40 a ventilator 60 of the type comprising an elongate facing member 61 mounted by parallel motion linkages 50 onto the housing 30 such that lengthwise movement of the facing member 61 produces movement of the facing member 61 towards or away from the housing 30 between a fully closed position obstructing the air passage and the fully open position. The operation of such a ventilator 60 is shown more clearly in FIG. 5. The ventilator has a facing member strip 61 which is a T in section having a rearwardly extending flange 62 over part of its length. The rearwardly extending flange 62 is connected to each of the hinges 50 through pivot pins 47. Further pivot pins 46 connect the hinges 50 with the upper and lower surfaces of the housing 30. The hinges 50 are within the box section 33 shown in FIG. 1. The twin pivots 46 and 47 of each hinge member 50 provide a parallel motion linkage. Movement of the facing strip 61 by use for example of the handle or snib 64 in the left-hand direction as shown in FIG. 5 will cause the facing strip 61 to pivot outwards from the housing 30 thereby permitting flow of air around the sides and back of the facing strip 61 and through the box sections 31,32 and 33 thereby providing an air passageway through the ventilator housing 30.

The housing 30 is provided with a cranked channel 55 which is substantially a right-angle in section. The channel 55 thus comprises a first substantially horizontal section and a second substantially vertical section extending up from the base of the said first section. A hood or cowl 58 is provided with an extension 59 which complements the channel 55. When the extension 59 of the hood 58 is slid within the channel 55, the engagement of the extension 59 and the channel 55 will provide a substantial degree of location and torsional rigidity thereby achieving a substantially permanent connection between the hood 58 and the housing 30 by a single operation. The part of the housing 30 defining the lower horizontal edge of the channel 55 is terminated slightly short of the hood to provide a recess 65 within which is located the upper edge of a perforated strip 70, the bottom edge of the strip 70 being located in a comparable channel provided in the lower part of the housing 30 adjacent the facing surface 35. The whole arrangement is assembled by slotting the lower edge of the perforated screen 70 into the lower recess, placement of the hood in position with its extension 59 within the channel 55 in effect locking and locating the screen in position between the hood 58 and the housing 30.

The housing 30 is affixed to the upper bar 14 of the window frame by any appropriate means, e.g. by affixation from the sides or ends of the ventilator.

The sash 20 is provided with a catch arrangement 28 which cooperates with a keep 29 to lock the two sashes together in the closed position. When the catch 28 is retracted the lower sash 20 may be raised fully such that its upper edge is substantially parallel with the upper edge 16 of the outer sash 18. The surface 35 of the housing facing the outer sash 20 is provided with vertically depending flanges 75 and 76 to define a channel to receive and locate the upper sash 18.

When the ventilator 60 is in its open position so that air may pass around the facing strip 60 and through the lateral face 42, air may pass in either direction through the ventilator housing 30, that is to say either from the exterior A to the interior B or vice versa. Passage of air from the exterior A to the interior B may carry with it particulates such as dust or moisture. The screen 70 and hood 58 will to a substantial degree control or prevent this. However, it is believed that providing the cranked air flow through the ventilator, in effect running along or parallel to surfaces 35,36 and 37 in succession, will provide an additional hindrance to passage of such extraneous matter.

Figure 2:
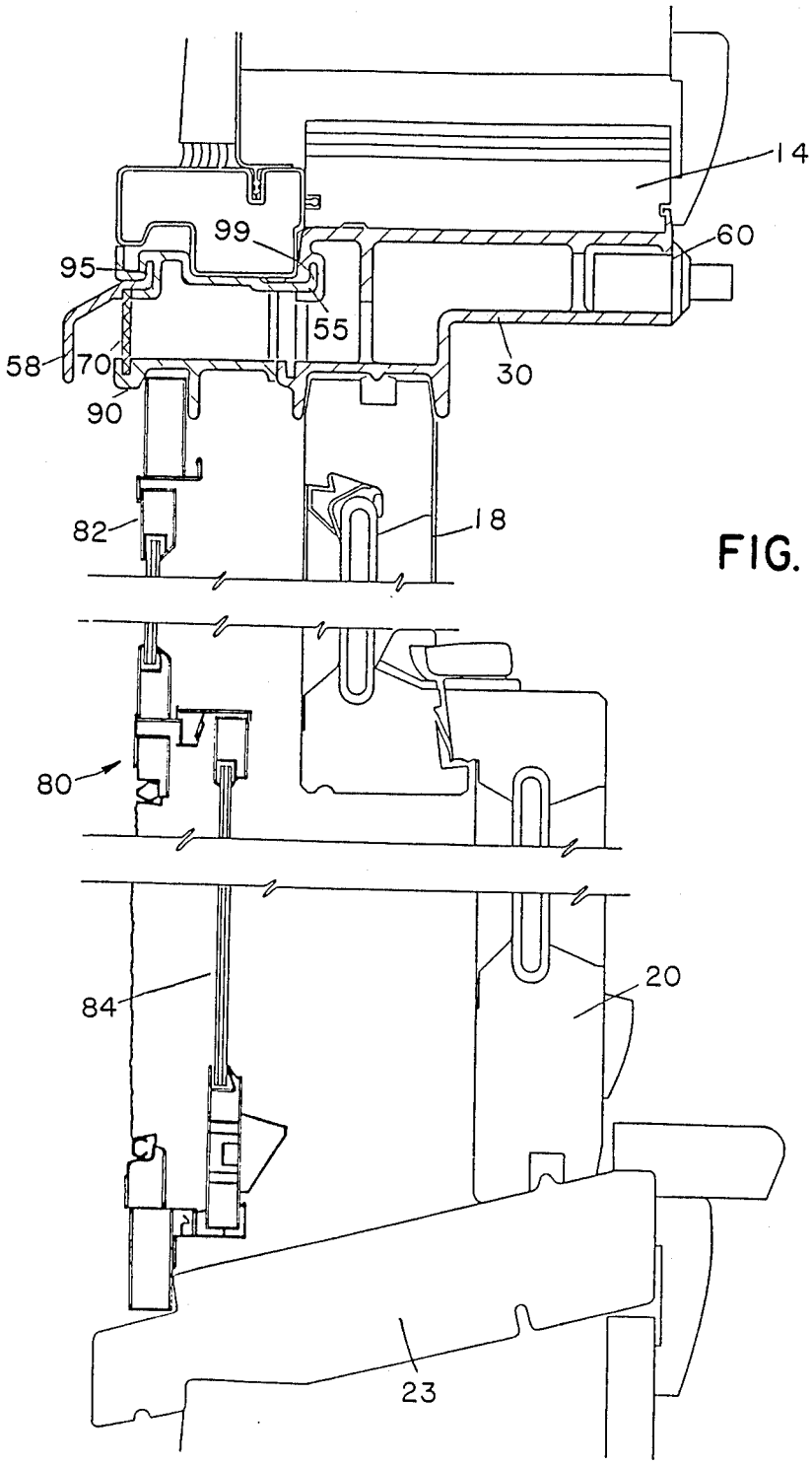
FIG. 2 is a cross-sectional view of the window/ventilator assembly of FIG. 1 but with a spacer arranged for location of a storm screen.

Turning now to FIG. 2 there will be seen a similar arrangement. In fact the housing 30, ventilator 60 and window/sash arrangement 14, 18, 20 and 23 is identical to that shown in FIG. 1. The difference in the provision of a storm screen arrangement 80 which itself is provided with inner and outer sashes 82 and 84. There is however between the hood 58 and the housing 30 a hood spacer 90. The spacer 90 has an extension 99 corresponding to the dimensions and location of the extension 59 of the hood 58 such that the extension 99 may locate itself within the channel 55 of the housing. The outer end of the spacer 90 has a channel 95 corresponding to the channel 55 such that the hood 58 may locate itself in relation to the spacer in the same way as it would locate itself in relation to the housing 30. The arrangement for affixing the perforated screen 70 between the hood 58 and the spacer 90 is otherwise identical to that previously described. The lower surface of the spacer 90 is provided with flanges for receiving and locating the sashes 82 and 84.

Figure 3:
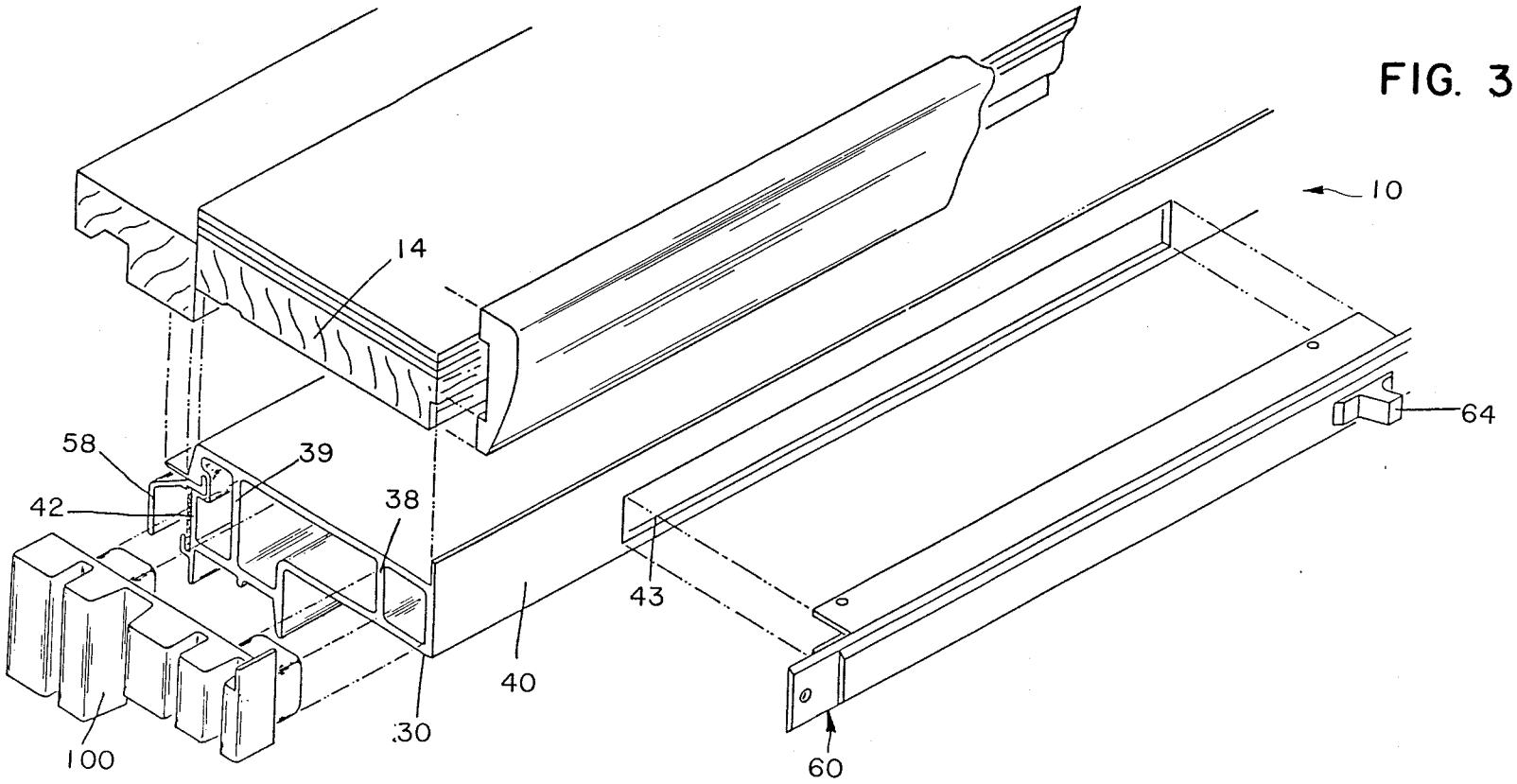
FIG. 3 shows another view of the assembly of the ventilator of FIG. 1 partially in section.

Turning now to FIG. 3, there will be seen an exploded view of the ventilator 10 as otherwise shown in FIG. 1. The view has been expanded to clarify the positioning of the ventilator itself 60 in relation to the housing 30 and the relationship of the housing 30 to the upper bar 14 of the window frame. The numerals in common between FIGS. 3 and 1 refer to the same integers.

In FIG. 3 will be seen a slot entry 43 routed out of the facing strip 40. Corresponding slot entries will be provided in the walls 38, 39 and in the outer surface 42. The housing is provided with a molded end plug 100. A corresponding end plug is fitted into the opposite end of the housing 30 which opposite end is not shown in FIG. 3.

Figure 4:
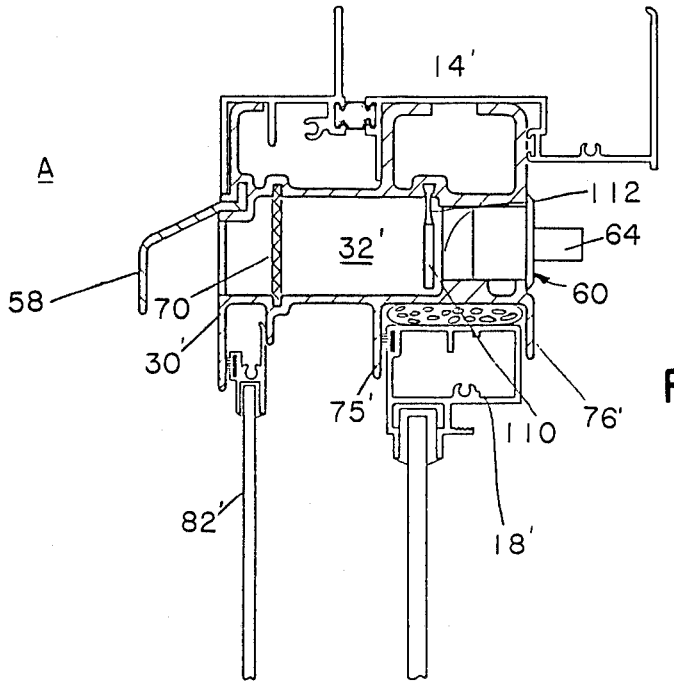
FIG. 4 is a cross-sectional view of a further ventilator arrangement according to an aspect of the invention.

FIG. 4 shows a further ventilator arrangement according to an aspect of the invention. Here a window frame 14' is provided with a housing 30', the upper part of which housing 30' being provided with means to cooperate with said frame 14'. The lower part of the housing 30' provides a chamber 32' which is provided at inner and outer faces with entry slots (not shown). Into the entry slot on the inner side of the housing 30' is inserted a ventilator 60 of the type previously described. A hood 58 is affixed to the housing at its outer side, the hood being affixed to the housing by an extension/channel arrangement corresponding to that described at 55/59 in relation to FIG. 1. A perforated screen 70 is provided within the chamber 32'. There is also provided within the chamber 32' a flap 110 which is affixed to the housing by a flexible connection 112. The linkages of the ventilator 60 (which linkages are described above in relation to FIG. 5) may preferably be provided with an extension 49 (not shown in FIG. 4) which forces the flap 110 towards the interior of the cavity 32' when the ventilator 60 is opened. The flexibility of the linkage 112 is such that the flap returns to its substantially vertical "closed" position when the ventilator 60 itself is in a closed position. Flanges 75' and 76' are provided on the lower side of the housing 30' presenting a channel for receipt of the upper bar of a sash 18'. Further flanges are provided for similar receipt of a storm screen sash 82'.

What is claimed is:

1. A ventilator assembly for a sliding sash window comprising an elongate ventilator housing with inner and outer lateral faces, an air passage through and between its inner and outer lateral faces and an elongate facing member mounted on hinges of a parallel motion linkage onto said ventilator housing such that lengthwise movement of said facing member produces movement of said facing member towards or away from said housing between a fully closed position obstructing said air passage and a fully open position, the hinge being positioned within the air passage in the housing, a first airflow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

2. An assembly as claimed in claim 1, wherein the sliding sash window comprises a window frame, inner lower and outer upper sashes mounted to slide respectively within inner and outer channels in said window frame, and a ventilator located between said sashes and said window frame.

3. A ventilator assembly for a sliding sash window comprising an elongate ventilator housing comprising a uniform section extrusion with inner and outer lateral faces, an air passage extending through the housing perpendicular to its length between openings formed in its inner and outer lateral faces, an elongate facing member mounted on hinges of a parallel motion linkage onto said ventilator housing such that lengthwise movement of said facing member produces movement of said facing member towards or away from said housing between a fully closed position obstructing said air passage and a fully open position, the hinges being positioned within the air passage in the housing, the housing also defining an outer sash facing surface.

4. A ventilator assembly according to claim 3, in which said air passage comprises a first airflow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

5. An assembly as claimed in claim 3, wherein the sliding sash window comprising a window frame, inner lower and outer upper sashes mounted to slide respectively within inner and outer channels in said window frame, and a ventilator located between said sashes and said window frame.

6. A sash window according to claim 5, wherein said ventilator is located between said outer upper sash and said window frame.

7. A sash window as claimed in claim 6, in which said ventilator is affixed to said window frame.

8. A sash window as claimed in claim 7, in which said outer sash facing surface has substantially vertically depending flanges defining a channel to receive said outer upper sash.

9. A sash window as claimed in claim 5 further provided at its outer lateral face with an angular longitudinally extending channel for location of a member selected from the group consisting of an elongate exterior hood and a spacer for said elongate hood.

10. A sash window according to claim 9, in which said angular channel comprises a first substantially horizontal section and a second substantially vertical section extending from the base of said first section.

11. A sash window as claimed in claim 5 in which upper and lower channel means are provided to locate a perforated screen over at least a portion of the outer face entry to said air passage.

12. A sash window according to claim 11 in which said upper means for location of said perforated screen is defined in part by said housing and in part by said hood.

13. A ventilator assembly for a sliding sash window, comprising an elongate ventilator housing comprising a uniform section extrusion with an air passage extending through the housing perpendicular to its extruded length between openings form in its inner and outer lateral faces, an elongate facing member mounted by a parallel motion linkage onto said ventilator housing such that lengthwise movement of said facing member produces movement of said facing member towards or away from said housing between a fully closed position obstructing said air passage and fully open position, the assembly further being provided at its outer lateral face with an angular longitudinally extending channel for location of an elongate exterior hood, which angular channel comprises a first substantially horizontal section and a second substantially vertical section extending from the base of said first section.

14. A ventilator assembly according to claim 13, in which said housing extrusion includes two spaced vertically external flanges defining between them a channel for a window sash.

15. An assembly as claimed in claim 13, wherein the sliding sash window comprises a window frame, inner lower and outer upper sashes mounted to slide respectively within inner and outer channels in said window frame and a ventilator located between said sashes and said window frame.

16. A ventilator assembly according to claim 13, in which said housing extrusion includes two spaced vertically external flanges defining between them a channel for a window sash.

17. A sash window according to claim 15, wherein said ventilator is located between said outer upper sash and said window frame.

18. A sash as claimed in claim 17, in which said ventilator is affixed to said window frame.

19. A sash window as claimed in claim 18, in which said outer sash facing surface has substantially vertically depending flanges defining a channel to receive said outer upper sash.

20. A sash window as claimed in claim 15, in which upper and lower channel means are provided to locate a perforated screen over at least a portion of the outer face entry to said air passage.

21. A sash window as claimed in claim 20, in which said upper channel means for location of said perforated screen is defined in part by said housing and in part by said hood.

22. A sash window according to claim 16 wherein said ventilator is located between said outer upper sash and said window frame.

23. A sash window as claimed in claim 22 in which said ventilator is affixed to said window frame.

24. A sash window as claimed in claim 23 in which said outer sash facing surface has substantially vertically depending flanges defining a channel to receive said outer upper sash.

25. A sash window as claimed in claim 16, further provided at its outer lateral face with an angular longitudinally extending channel for location of a member selected from the group consisting of an elongate exterior hood and a spacer for said elongate hoot.

26. A sash window as claimed in claim 16, in which upper and lower channel means are provided to locate a perforated screen over at least a portion of the outer face entry to said air passage.

27. A sash window according to claim 13 in which said upper channel means for location of said perforated screen is defined in part by said housing and in part by said hood.

28. A sash window comprising a window frame, inner lower and outer upper sashes mounted to slide respectively within inner and outer channels in said window frame, and a ventilator located between said sashes and said window frame, the said ventilator comprising an elongate ventilator housing having an air passage through and between its inner and outer lateral faces and an elongate facing member mounted by a parallel motion linkage onto said ventilator housing such that length wise movement of said facing member produces movement of said facing member towards or away from said housing between a fully closed position obstructing said air passage and a fully open position, the housing further having substantially horizontal inner and outer sash facing surfaces, said inner and outer sash facing surfaces being substantially parallel to and spaced from one another; the ventilator being further provided at its uter lateral face with an angular longitudinally extending channel for location of a member selected from the group consisting of an elongate exterior hood and a spacer for said elongate hood, and said air passage comprising a first air flow section adjacent said outer face of said housing, a third airflow section adjacent said inner face of said housing and a second airflow section linking said first and third airflow sections, said first and third airflow sections being substantially parallel to and spaced from one another and said second airflow section being substantially normal to said first and third airflow sections.

* * * * *